US011145185B2

(12) United States Patent
Davies et al.

(10) Patent No.: US 11,145,185 B2
(45) Date of Patent: Oct. 12, 2021

(54) VERIFICATION OF A BEACON OR STROBE IN A VAD

(71) Applicant: Electronic Modular Services Ltd., Herne Bay (GB)

(72) Inventors: John Davies, Milton Keynes (GB); Andrew White, Gillingham (GB)

(73) Assignee: ELECTRONIC MODULAR SERVICES LTD., Herne Bay (GB)

( * ) Notice: Subject to any disclaimer, the term of this patent is extended or adjusted under 35 U.S.C. 154(b) by 0 days.

(21) Appl. No.: 15/734,837

(22) PCT Filed: Jun. 5, 2018

(86) PCT No.: PCT/GB2018/051529
§ 371 (c)(1),
(2) Date: Dec. 3, 2020

(87) PCT Pub. No.: WO2019/234375
PCT Pub. Date: Dec. 12, 2019

(65) Prior Publication Data
US 2021/0233387 A1 Jul. 29, 2021

(51) Int. Cl.
*G08B 29/12* (2006.01)
*G08B 7/06* (2006.01)
*G08B 5/38* (2006.01)

(52) U.S. Cl.
CPC ..... *G08B 29/126* (2013.01); *G08B 5/38* (2013.01); *G08B 7/06* (2013.01)

(58) Field of Classification Search
CPC ..... G08B 29/126
See application file for complete search history.

(56) References Cited

U.S. PATENT DOCUMENTS

| | | | |
|---|---|---|---|
| 6,696,799 | B2 | 2/2004 | Vukosic |
| 7,123,165 | B2 | 10/2006 | Davenport et al. |
| 7,369,037 | B2 | 5/2008 | Piccolo, III et al. |
| 7,400,226 | B2 | 7/2008 | Barrieau et al. |
| 8,228,182 | B2 | 7/2012 | Orsini et al. |
| 8,508,359 | B2 | 8/2013 | Piccolo |

(Continued)

OTHER PUBLICATIONS

ISR/WO; Application No. PCT/GB2018/051529/ mailed Feb. 12, 2019; 15 pages.

*Primary Examiner* — Travis R Hunnings
(74) *Attorney, Agent, or Firm* — Cantor Colburn LLP

(57) ABSTRACT

Disclosed is a hazard detection system having: a visual alarm device (VAD) including a VAD controller which is an electronic controller, the VAD controller controlling a plurality of implements within the VAD including a light source, and a luminosity sensor with which the VAD controller is configured to perform a VAD health test to confirm that a plurality of parameters of the light source meet or exceed threshold requirements, the plurality of parameters including luminous intensity and luminous profile, wherein the VAD is configured to perform steps including: monitoring for a trigger event to perform the VAD health test, the trigger event including the occurrence of an alarm a condition; activating the light source upon determining that the trigger event has occurred; monitoring the plurality of parameters to determine whether the light source meets or exceeds threshold requirements, and communicating an outcome of the VAD health test.

20 Claims, 4 Drawing Sheets

(56) References Cited

U.S. PATENT DOCUMENTS

| | | | | |
|---|---|---|---|---|
| 8,760,280 | B2 | 6/2014 | Piccolo | |
| 8,773,254 | B2 | 7/2014 | Piccolo | |
| 8,797,157 | B2 | 8/2014 | Haynes | |
| 8,994,525 | B2 | 3/2015 | Piccolo et al. | |
| 9,007,201 | B2 | 4/2015 | Piccolo et al. | |
| 9,030,314 | B2 | 5/2015 | Piccolo, III et al. | |
| 9,076,313 | B2 | 7/2015 | Piccolo et al. | |
| 9,373,245 | B2 | 6/2016 | Gerrish et al. | |
| 9,552,720 | B2 | 1/2017 | Moffa | |
| 9,659,485 | B2 | 5/2017 | Piccolo | |
| 9,679,468 | B2 | 6/2017 | Piccolo | |
| 9,767,679 | B2 | 9/2017 | Piccolo et al. | |
| 2005/0057353 | A1 | 3/2005 | Barrieau et al. | |
| 2006/0017583 | A1 | 1/2006 | Davenport et al. | |
| 2010/0315224 | A1* | 12/2010 | Orsini | G08B 29/126 340/516 |
| 2012/0286946 | A1* | 11/2012 | Karl | G08B 29/126 340/516 |
| 2014/0340215 | A1 | 11/2014 | Piccolo, III et al. | |
| 2016/0267775 | A1 | 9/2016 | Berezowski et al. | |

* cited by examiner

VERIFICATION OF A BEACON OR STROBE IN A VAD

CROSS REFERENCE TO RELATED APPLICATIONS

This is a US National Stage of Application No. PCT/GB2018/051529, filed on Jun. 5, 2018, the disclosure of which is incorporated herein by reference.

BACKGROUND

Exemplary embodiments pertain to the art of hazard warning devices and more specifically to verification of a beacon or strobe in a visual alarm device (VAD).

When utilizing hazard warning device such as visual alarm devices (VAD), more particularly such as smoke, heat or gas warning devices, checking the health of the strobe light source may require visually confirming a correct brightness and duration of flash at each individual device. Such checking may be done with a lux meter. Environmental conditions at which the strobes are checked may be difficult to control making comparative measurements challenging. When the strobe source is a light emitting diode (LED), the LED may degrade over a device lifetime, compounding the issue.

BRIEF DESCRIPTION

Disclosed is a hazard detection system comprising: a visual alarm device (VAD) including a VAD controller which is an electronic controller, the VAD controller controlling a plurality of implements within the VAD including a light source, and a luminosity sensor with which the VAD controller is configured to perform a VAD health test to confirm that a plurality of parameters of the light source meet or exceed threshold requirements, the plurality of parameters including luminous intensity and luminous profile, wherein the VAD is configured to perform steps including: monitoring for a trigger event to perform the VAD health test, the trigger event including the occurrence of an alarm condition; activating the light source upon determining that the trigger event has occurred; monitoring the plurality of parameters to determine whether the light source meets or exceeds threshold requirements, and communicating the outcome of the health test.

In addition to one or more of the above disclosed features or as an alternate, the light source comprises a button and the VAD is configured to perform a VAD health test upon determining that the button is depressed.

In addition to one or more of the above disclosed features or as an alternate, the system comprises a system controller configured to communicate with the VAD over an electronic network and the VAD is configured to perform a VAD health test upon determining that the system controller has electronically transmitted instructions to initiate the VAD health test.

In addition to one or more of the above disclosed features or as an alternate, the VAD is configured to communicate a fault alert to the system controller and the system controller is configured to provide a visual alert when the VAD fails the VAD health test.

In addition to one or more of the above disclosed features or as an alternate, the VAD is configured to test luminous stability during a VAD health test only if the VAD health test indicates that luminous intensity meets or exceeds threshold requirements.

In addition to one or more of the above disclosed features or as an alternate, the system includes an audible source, which is an alarm speaker.

In addition to one or more of the above disclosed features or as an alternate, the system controller is configured to provide an audible alert when the VAD fails the VAD health test.

In addition to one or more of the above disclosed features or as an alternate, the light source is an LED or a plurality of LEDs.

In addition to one or more of the above disclosed features or as an alternate, the VAD is configured to autonomously initiate the VAD health test periodically including during an emergency situation of the VAD to ensure the output is maintained.

In addition to one or more of the above disclosed features or as an alternate, the system comprises a plurality of similarly configured VADS.

Further disclosed is method of operating a hazard detection system, wherein the system comprises: a visual alarm device (VAD) including one or more of the above disclosed steps and/or features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
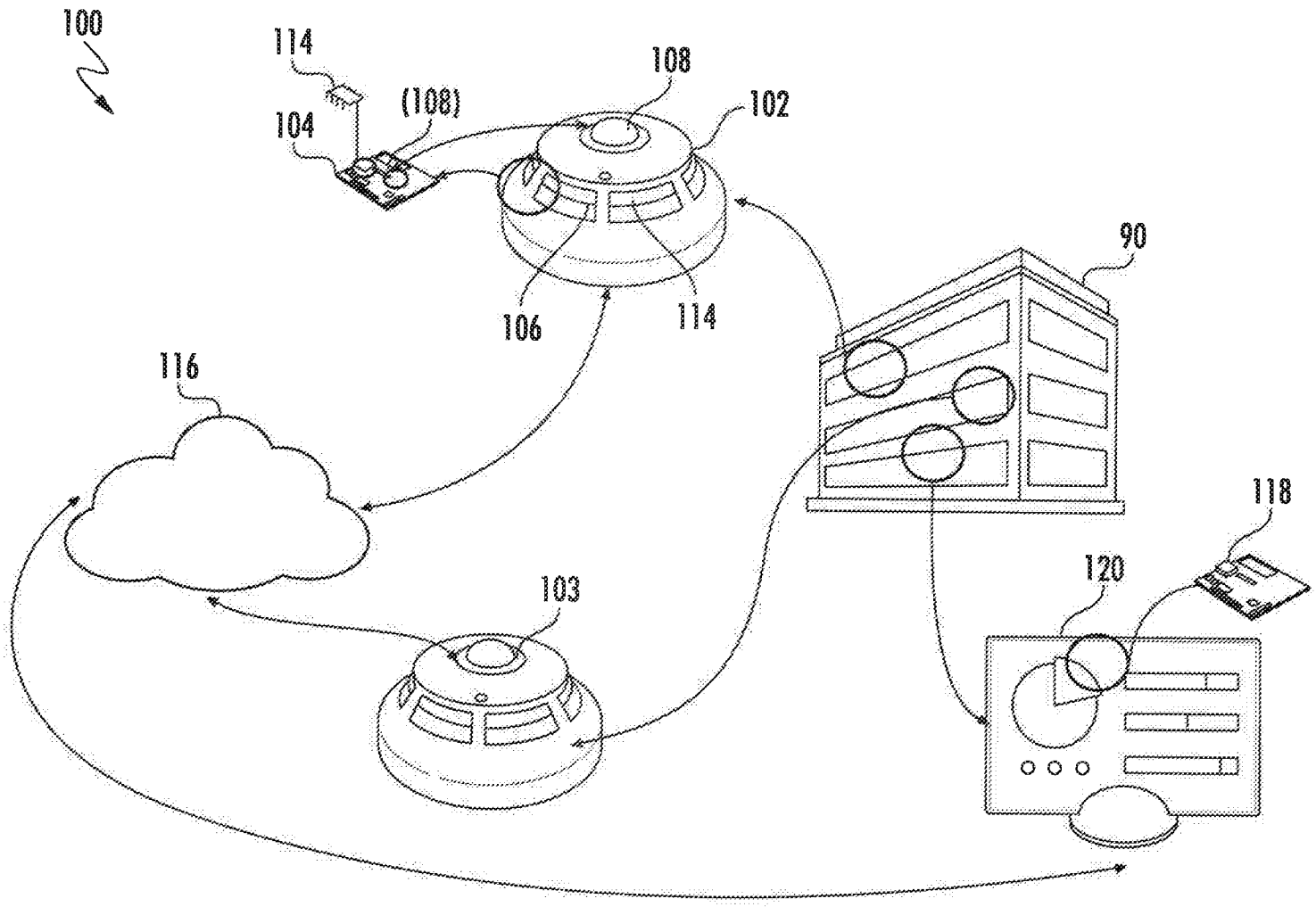
FIG. 1 illustrates networked VADs according to an embodiment.

An environment for the disclosed innovation is illustrated in FIG. 1. A commercial building 90 such as an office complex may have a networked detection system 100. The networked detection system 100 may include a plurality of hazard warning devices which are a plurality of visual alarm devices (VAD) including a first VAD 102 and a second VAD 103. The plurality of VADs may be substantially identical smoke, heat or gas warning devices, so that hereinafter the first VAD 102 will be referred to alternatively as VAD 102.

Figure 2:
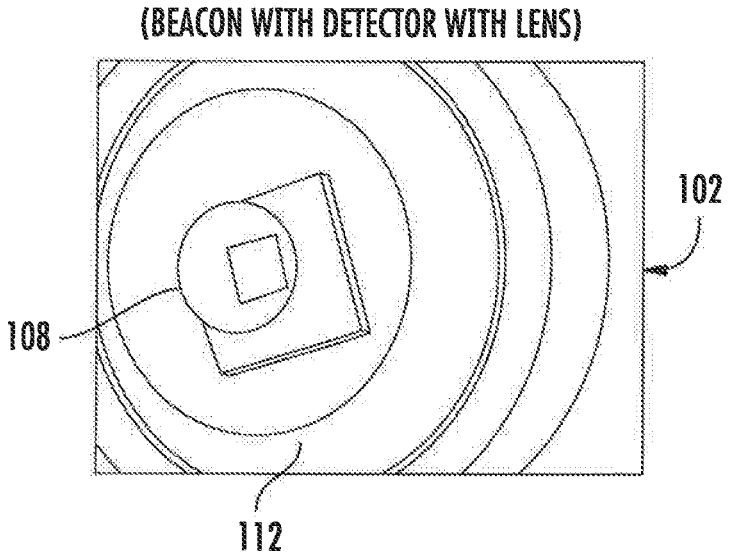
FIG. 2 illustrates a strobe from a VAD with a lens installed according to an embodiment.
Figure 3:
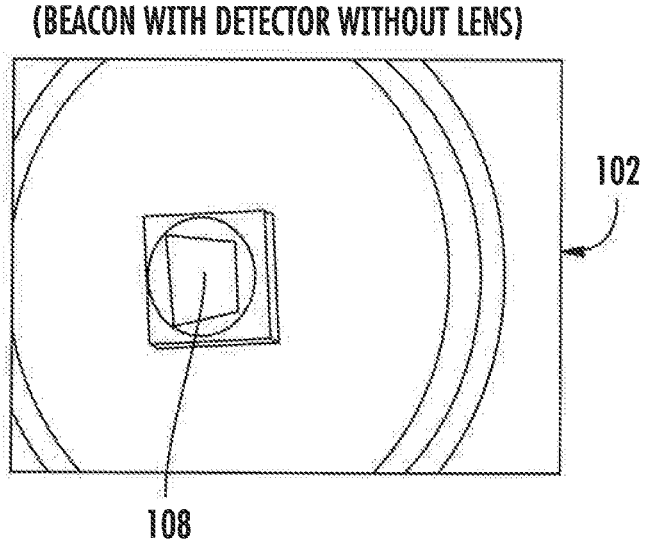
FIG. 3 illustrates a strobe from a VAD without a lens installed according to an embodiment.

With reference to FIGS. 1-3, the VAD 102 may include a VAD controller 104 which may be an electronic controller. The VAD controller 104 may control a plurality of implements within the VAD 102. The plurality of implements may include an audio source 106 which may be an alarm speaker 106. The plurality of implements may further include a light source 108, which may be a strobe light and more specifically a light emitting diode (LED) light. In some embodiments the light source 108 may also serve as a test control button that is depressed to initiate a test of the VAD 102 or suspend operation of the VAD 102 during a test.

The plurality of implements may further include a sensor 114 with which the VAD controller 104 is capable of measuring various parameters of the LED 110 during a test or actual operation of the LED 110, for example during an emergency. The measured parameters include the luminous intensity of the LED 110, for example to confirm that the LED 110 meets predefined minimum luminous intensity requirements. In addition, the measured parameters include the luminous profile, that is, to confirm that the LED 110 meets the luminous intensity requirements for a duration that meets predefined minimum threshold duration requirements. These parameters are not intended to be limiting.

The VAD 102 may communicate over an electronic network 116 with a system controller 118, which may be an electronic controller, within a system data hub 120. The system controller 118 may be able to initiate VAD health tests of the plurality of VADs, and to indicate the results of the tests, such as pass and fail. For example, if the second VAD 103 fails a VAD health test, a notice may be provided on the data hub 120 indicating a need to replace the second VAD 103. The notice may be provided as an audible alert, a visual alert, such as on a display board, an SMS text message, or the like.

The above network 116 may be an electronic short range communications (SRC) network, such as a private area network (PAN). PAN technologies include, for example, Bluetooth Low Energy (BTLE), which is a wireless technology standard designed and marketed by the Bluetooth Special Interest Group (SIG) for exchanging network access codes (credentials) over short distances using short-wavelength radio waves. PAN technologies also include Zigbee, a technology based on Section 802.15.4 from the Institute of Electrical and Electronics Engineers (IEEE). More specifically, Zigbee represents a suite of high-level communication protocols used to create personal area networks with small, low-power digital radios for low-power low-bandwidth needs, and is suited for small scale projects using wireless connections. Alternatively, the network 116 may be a local area network (LAN) using protocols such as WiFi, which is a technology based on the Section 802.11 from the IEEE. Of course, these are non-limiting examples of wireless telecommunication protocols.

Figure 4:
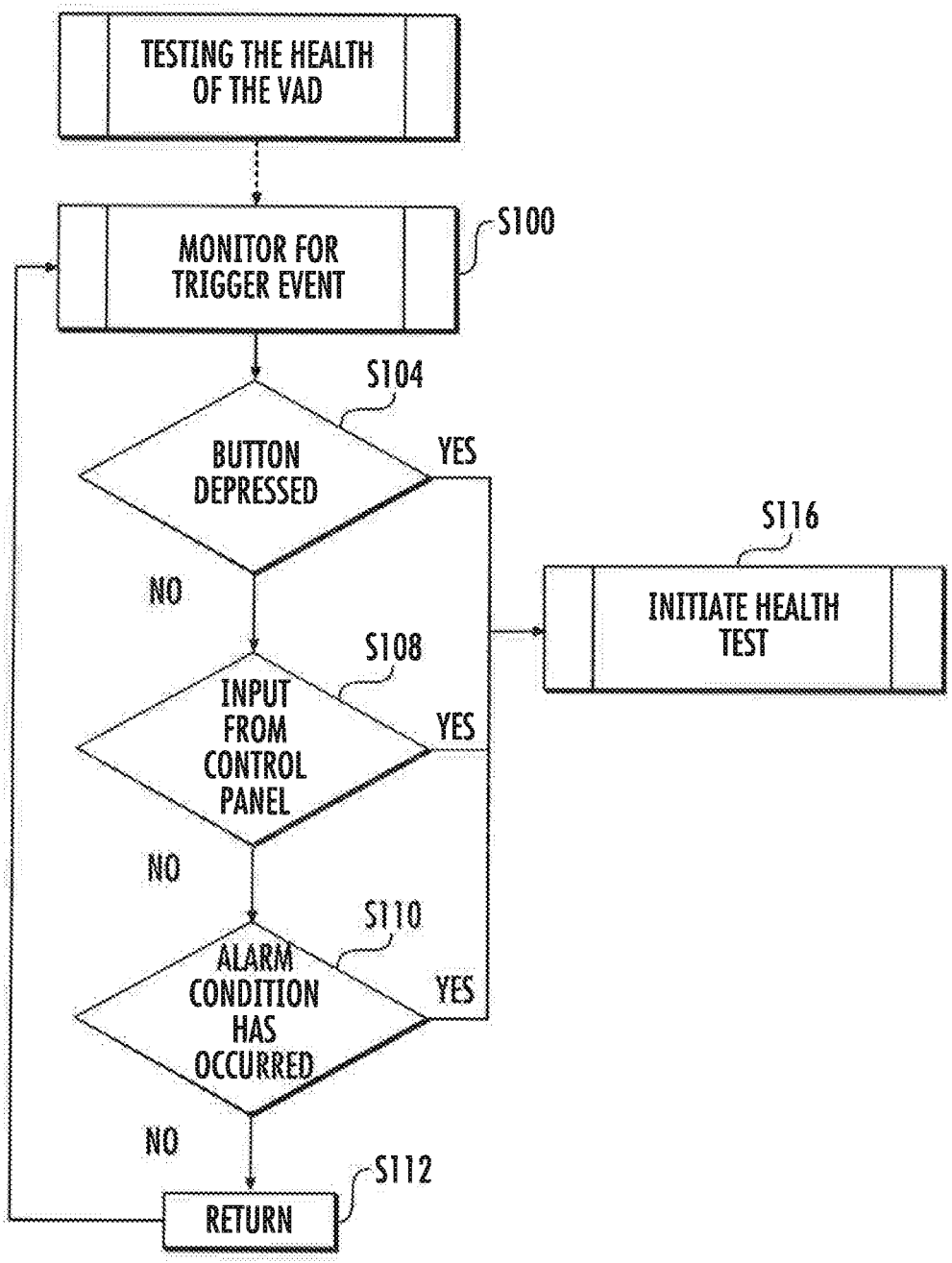
FIG. 4 illustrates a process for performing a VAD health test according to an embodiment.
Figure 5:
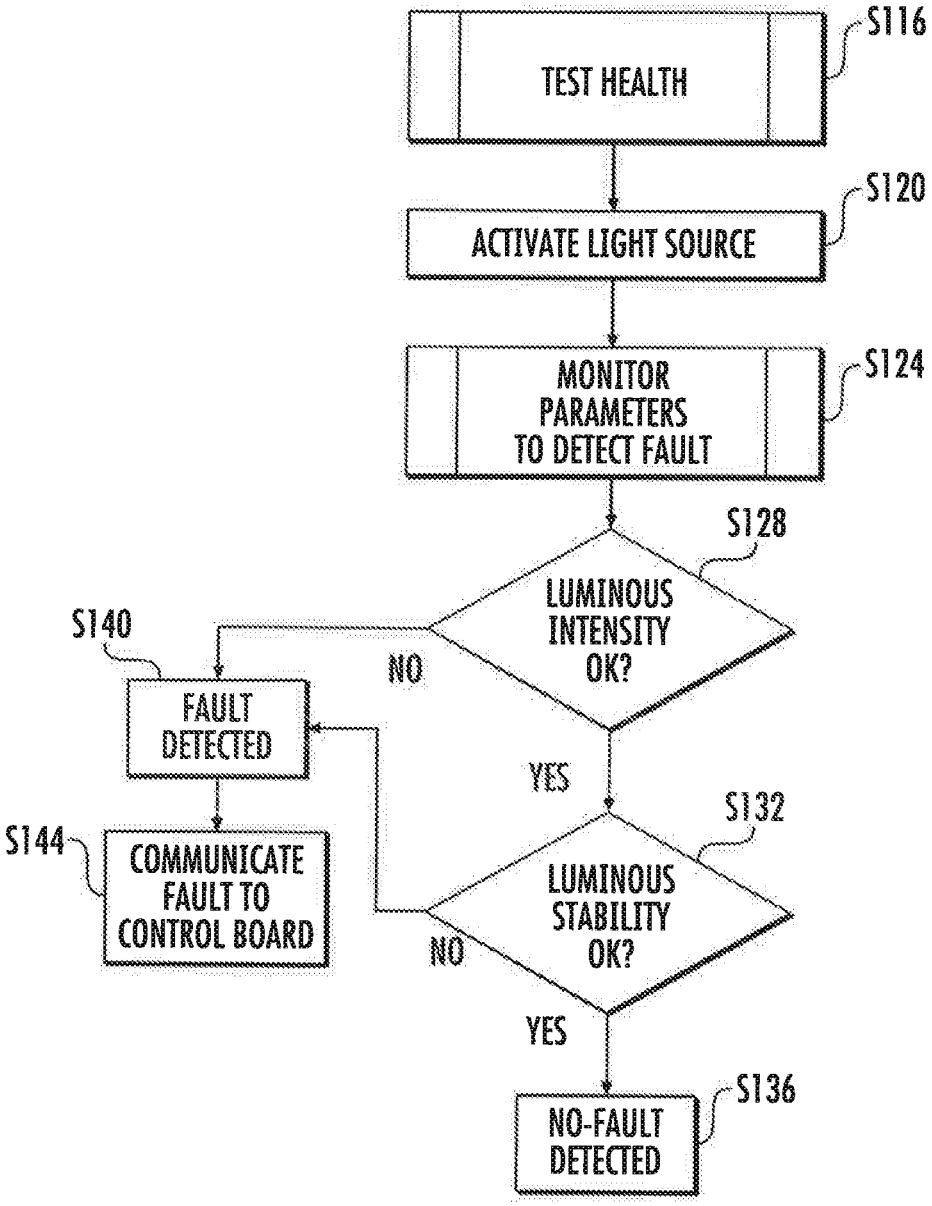
FIG. 5 illustrates a process for performing a VAD health test according to an embodiment.

Turning to FIGS. 4-5, a process of testing the health of the VAD 102 is illustrated. At step S100, the VAD 102 monitors for a trigger event to perform a VAD health test. Step S100 includes step S104 the VAD 102 monitoring for depression of the button 108 to initiate a VAD health test. Step S100 also includes step S108 of monitoring for communications over the network 116 from the system controller 118 with instructions to initiate a VAD health test, for example, as a part of a system-wide periodic test. Step S100 may include step S110 of determining that an alarm condition has occurred. The order of steps S104, S108 and S110 as provided herein is not exclusive. While the determination at each of steps S104, S108 and S110 is "no", at step S112 the VAD returns to step S100. In one embodiment, the VAD autonomy initiates the VAD health test periodically.

When the determination at either of steps S104, S108 or S110 is "yes", the VAD 102 executes step S116 of initiating a VAD health test. Step S116 includes step S120 of activating the strobe light and optionally speaker audio. During this time, at step S124, the VAD 102, through the sensor 114, monitors the test parameters, including the luminous intensity and luminous profile to determine whether a fault exists. Step S124 includes step S128 of determining whether the sensed luminous intensity meets and/or exceeds threshold luminous intensity requirements.

If the determination is "yes" at step S128 then at step S32 the VAD 102 determines whether the luminous profile meets and/or exceeds threshold luminous profile requirements. If the determination is "yes" at step S132 then at step S136 the VAD 102 determines that no fault is detected in this VAD health test. If the determination is "yes" at step S128 or step S132 then at step S140 the VAD 102 determines that a fault is detected in this VAD health test. At step S144 the VAD 102 communicates the existence of the fault with the system controller 118. Thereafter, a notification is provide by the at the system data hub 120, such as a visual alert or other type of alert, indicating that the VAD 102 should be replaced.

With the above disclosure, the VAD 102 sensor 114 measures the internal reflection of light from the LED 108 or strobe. The measurement is synchronous to the strobe and may detect that the light is above a certain threshold and maintained for a threshold period, which is the period of the flash. In other words, the VAD 102 may detect whether the strobe is operational and may detect the pulse duration of the strobe flash. Failure modes of the LED and power supply may result in the flash being shorter that required. This may include degradation of an internal storage capacitor on the VAD controller.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A hazard detection system comprising:

a visual alarm device (VAD) including a VAD controller which is an electronic controller, the VAD controller controlling a plurality of implements within the VAD including a light source, and a luminosity sensor with which the VAD controller is configured to perform a VAD health test to confirm that a plurality of parameters of the light source meet or exceed threshold requirements, the plurality of parameters including luminous intensity and luminous profile, wherein the VAD is configured to perform steps including:

monitoring for a trigger event to perform the VAD health test, the trigger event including the occurrence of an alarm condition;

activating the light source upon determining that the a trigger event has occurred;

monitoring the plurality of parameters to determine whether the light source meets or exceeds threshold requirements, and communicating an outcome of the VAD health test.

2. The system of claim 1 wherein the light source comprises a button and the VAD is configured to perform a VAD health test upon determining that the button is depressed.

3. The system of claim 2 comprising a system controller configured to communicate with the VAD over an electronic network and the VAD is configured to perform a VAD health test upon determining that the system controller has electronically transmitted instructions to initiate the VAD health test.

4. The system of claim 3 wherein the VAD is configured to communicate the fault alert to the system controller and the system controller is configured to provide a visual alert when the VAD fails the VAD health test.

5. The system of claim 4 wherein the VAD is configured to test the luminous profile during a VAD health test only if the VAD health test indicates that luminous intensity meets or exceeds threshold requirements.

6. The system of claim 5 including an audible source, which is an alarm speaker.

7. The system of claim 6 wherein the system controller is configured to provide an audible alert when the VAD fails the VAD health test.

8. The system of claim 7 wherein the light source is an LED or a plurality of LEDs.

9. The system of claim 8 wherein the VAD is configured to autonomously initiate the VAD health test periodically.

10. The system of claim 9 comprising a plurality of similarly configured VADS.

11. A method of operating a hazard detection system, wherein the system comprises:

a visual alarm device (VAD) including a VAD controller which is an electronic controller, the VAD controller controlling a plurality of implements within the VAD including a light source, and a luminosity sensor with which the VAD controller is configured to perform a VAD health test to confirm that a plurality of parameters of the light source meet or exceed threshold requirements, the plurality of parameters including luminous intensity and luminous profile, wherein the method comprises the VAD performing steps including:

monitoring for a trigger event to perform the VAD health test, the trigger event including the occurrence of an alarm condition;

activating the light source upon determining that the trigger event has occurred;

monitoring the plurality of parameters to determine whether the light source meets or exceeds threshold requirements, and communicating an outcome of the VAD health test.

12. The method of claim 11 wherein the light source comprises a button and the VAD is configured to perform a VAD health test upon determining that the button is depressed.

13. The method of claim 12 comprising a system controller configured to communicate with the VAD over an electronic network and the VAD is configured to perform a VAD health test upon determining that the system controller has electronically transmitted instructions to initiate the VAD health test.

14. The method of claim 13 wherein the VAD is configured to communicate the fault alert to the system controller and the system controller is configured to provide a visual alert when the VAD fails the VAD health test.

15. The method of claim 14 wherein the VAD is configured to test the luminous profile during a VAD health test only if the VAD health test indicates that luminous intensity meets or exceeds threshold requirements.

16. The method of claim 15 including an audible source, which is an alarm speaker.

17. The method of claim 16 wherein the system controller is configured to provide an audible alert when the VAD fails the VAD health test.

18. The method of claim 17 wherein the light source is an LED or a plurality of LEDs.

19. The method of claim 18 wherein the VAD is configured to autonomously initiate the VAD health test periodically.

20. The method of claim 19 wherein the system comprises a plurality of similarly configured VADS.

* * * * *